United States Patent [19]

Torrey

[11] Patent Number: 4,796,064

[45] Date of Patent: Jan. 3, 1989

[54] CYCLE-UP CONTROL SCHEME

[75] Inventor: Arthur L. Torrey, Rochester, N.Y.

[73] Assignee: Xerox Corporation, Stamford, Conn.

[21] Appl. No.: 142,591

[22] Filed: Jan. 11, 1988

[51] Int. Cl.[4] ..... G03G 15/02

[52] U.S. Cl. ..... 355/14 CH; 355/3 CH

[58] Field of Search ..... 355/14 CH, 3 CH, 14 R, 355/3 R

[56] References Cited

U.S. PATENT DOCUMENTS

| | | | |
|---|---|---|---|
| 4,326,796 | 4/1982 | Champion | 355/3 CH |
| 4,348,099 | 9/1982 | Fantozzi | 355/14 E |
| 4,355,885 | 10/1982 | Nagashima | 355/14 CH |
| 4,456,370 | 6/1984 | Hayes | 355/14 CH |
| 4,484,811 | 11/1984 | Nakahata et al. | 355/14 CH |
| 4,512,652 | 4/1985 | Buck et al. | 355/14 CH |
| 4,564,287 | 1/1986 | Suzuki et al. | 355/14 CH |
| 4,592,646 | 6/1986 | Suzuki et al. | 355/14 CH |

FOREIGN PATENT DOCUMENTS

| | | | |
|---|---|---|---|
| 60-203968 | 10/1985 | Japan | 355/14 CH |

*Primary Examiner*—R. L. Moses

*Attorney, Agent, or Firm*—Ronald F. Chapuran

[57] ABSTRACT

A control device for adjusting the surface potential of an image bearing member of a machine during the initial cycles of a job run wherein the image bearing member manifests varying characteristics after completion of a job run. The control device includes a charging member to produce a surface potential on the image bearing member, a sensor to measure the surface potential on the image bearing member and logic circuitry responsive to the charging member and the sensor after a first cycle of the machine operation to control the charging member current during a second cycle of the machine operation in which the logic circuitry includes means to predict changed characteristics of the image bearing member after the completion of the first job run at the initiation of a second job run and the means to determine relationship between the charging current of the charging member and the measured surface potential of the image bearing member.

12 Claims, 3 Drawing Sheets

CYCLE-UP CONTROL SCHEME

BACKGROUND OF THE INVENTION

The present invention relates to image forming apparatus, and in particular, to the control of the surface potential of an image bearing member.

It is known in the art to control the surface potential of an image bearing surface. For example U.S. Pat. No. 4,512,652, commonly assigned discloses a control in a electrophotographic printing machine wherein the charging current for the photoconductive member of the printing machine is a function of the time elapsed between successive operating cycles of the machine and a constant characterizing the photoconductive member. U.S. Pat. No. 4,348,099, also assigned to the same assignee as the present invention, discloses a control loop to adjust the charging member in an electrophotographic machine. In particular, an electrometer measures the photoreceptor surface voltage level, compares it to a reference, and determines a voltage adjustment necessary for the charging cort to maintain a consistent photoreceptor surface voltage level.

In addition, U.S. Pat. No. 4,355,885 discloses an image forming apparatus provided with a surface potential control device wherein a magnitude of a measured value of a surface potential sensor and aimed potential value are discriminated and an output from an output device such as an exposure device is increased or decreased for a predetermined value by the discriminated output. The measuring, discriminating, adding and subtracting operations are repeated to control the surface potential within a predetermined range. U.S. Pat. No. 4,484,811 discloses an apparatus for forming an image on a recording member wherein in consecutive latent image forming cycles, a non-imaged area present between two consecutive latent images is exposed to a predetermined amount of light to form an electrostatic image, the potential of which is measured to control the development of a latent image.

In the prior art, it is known that certain types of image bearing members exhibit cyclic instability between the initial cycles of the machine particularly at machine start-up, primarily due to ambient conditions such as temperature, humidity and time period since the last shut down of the machine. In such machines, the charging member supplying the same current may produce a potential on the image bearing member that differs by as much as 250 volts between cycles.

It is common in such control loops to measure the voltage of the image bearing member against a reference and, in response, provide corrective feedback. Such control loops, however, adapt to measured conditions but do not predict correct parameters such as charging current based upon accumulated data.

To compensate for the above-identified difficulties, it would be desirable to provide a control that compensates for cyclic instability in the image bearing surface and does not merely adapt to measured and determined error signals.

It is an object of the present invention, therefore, to provide a new and improved image bearing surface control and in particular a control that compensates for cyclic instability in the image bearing member and also provides both a predictive and adaptive feedback control.

SUMMARY OF THE INVENTION

The present invention is a control device for adjusting the surface potential of an image bearing member of a machine during the initial cycles of a job run wherein the image bearing member manifests varying characteristics after completion of a job run. The control device includes a charging member to produce a surface potential on the image bearing member, a sensor to measure the surface potential on the image bearing member and logic circuitry responsive to the charging member and the sensor after a first cycle of the machine operation to control the charging member current during a second cycle of the machine operation in which the logic circuitry includes means to predict changed characteristics of the image bearing member after the completion of the first job run at the initiation of a second job run and the means to determine a relationship between the charging current of the charging member and the measured surface potential of the image bearing member.

DESCRIPTION OF THE DRAWINGS

For a better understanding of the present invention, reference may be had to accompanying drawings wherein the same reference numerals have been applied to like parts and wherein.

DESCRIPTION OF THE PREFERRED EMBODIMENT

Figure 1:
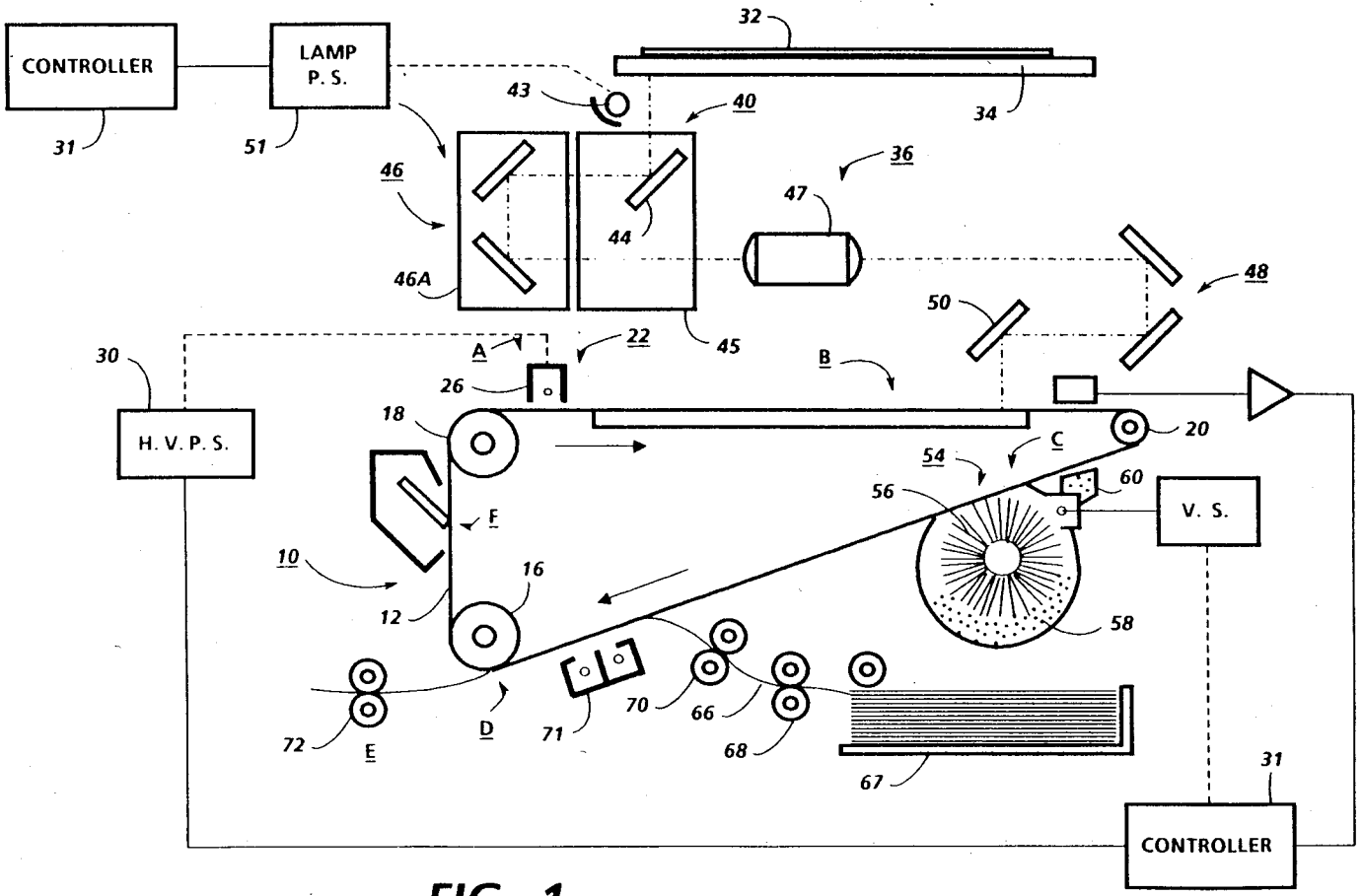
FIG. 1 is a representation of a reproducing apparatus incorporating the present invention.

FIG. 1 schematically depicts the various components of an illustrative electrophotographic printing machine incorporating the control system of the present invention therein. It will become apparent from the following discussion that this control system is equally well suited for use in a wide variety of electrophotographic printing machines and is not necessarily limited in its applications to the particular embodiment shown herein. Inasmuch as the art of electrophotographic printing is well known, the various processing stations employed in the FIG. 1 printing machine will be shown hereinafter schematically and their operation described briefly with references thereto.

Turning now to FIG. 1, the electrophotographic printing machine uses a photoreceptor belt 10 having a photoconductive surface 12 formed on a conductive substrate. Belt 10 moves in the indicated direction, advancing sequentially through the various xerographic process stations. The belt is entrained about drive roller 16 and tension rollers 18, and 20. Roller 16 is driven by conventional motor means, (not shown).

With continued reference to FIG. 1, a portion of belt 10 passes through charging station A where a corona generating device, indicated generally by the reference numeral 22, charges photoconductive surface 12 to a relatively high, substantially uniform, negative potential. Device 22 comprises a charging electrode 24 and a conductive shield 26. A high voltage supply controlled by a portion of controller 31, is connected to shield 26.

As belt continues to advance, the charged portion of surface 12 moves into exposure station B. An original document 32 is positioned, either manually or by a document feeder mechanism (not shown) on the surface of a transparent platen 34. Optics assembly 36 contains the optical components which incrementally scan-illuminate the document and project a reflected image onto surface 12 of belt 10. Shown schematically, these optical components comprise an illumination scan assembly 40, comprising illumination lamp 42, associated reflector 43 and full rate scan mirror 44, all three components mounted on a scan carriage 45. The carriage ends are adapted to ride along guide rails (not shown) so as to travel along a path parallel to and beneath the platen.

Lamp 42 illuminates an incremental line portion of documents 32. The reflected image is reflected by scan mirror 44 to coroner mirror assembly 46 on a second scan carriage 46A moving at ½ the rate of mirror 44. The document image is projected through lens 47 and reflected by a second coroner mirror 48 and belt mirror 50, both moving at a predetermined relationship so as to proceed the projected image while maintaining the required near conjugate onto surface 12 to form thereon an electrostatic latent image corresponding to the informational area contained within original document 32. Adjustable illumination power supply 51, controlled by a portion of controller 31, supplies power to lamp 42. It should be noted that other exposure means such as laser scanning and flash optical systems are contemplated within the scope of the invention.

The belt then advances past a DC electrometer 51, positioned adjacent to the photoconductive surface 12 between the exposure station B and development station C to generate a signal proportional to the dark development potential on the photoreceptor surface. The dark development potential is the charge maintained on the photoconductor after charging and exposure, reflected from an opaque target or object. Preferably, the electrometer 51 is a nulling type device having a not shown probe and head assembly and the potential of the head and probe assembly is raised to the potential of the surface being measured. The generated signal is conveyed to controller 31 through suitable conversion circuitry. The controller 31 is also electrically connected to a high voltage power supply 30 through suitable logic interface to control the bias voltage on the conductive shield 17 of the charging corotron in response to the generated signal from the electrometer to adjust the dark development potential.

At development station C, a magnetic brush development system, indicated generally by the reference numeral 54, advances an insulating development material into contact with the electrostatic latent image. Preferably, magnetic brush development system 54 includes a developer roller 56 within a housing 58. Roller 56 transports a brush of developer material deforms belt 10 in an arc with the belt conforming, at least partially, to the configuration of the developer material. The electrostatic latent image attracts the toner particles from the carrier granules forming a toner powder image on photoconductive surface 12. As successive latent images are developed, toner particles are depleted from the developer material. A toner particle dispenser, indicated generally by the reference numeral 60 provides additional toner particles to housing 58 for subsequent use by developer roller 56. Toner dispenser 60 includes a container for storing a supply of toner particles therein and means (not shown) for introducing the particles into developer housing 58.

An output copy sheet 66 taken from a supply tray 67, is moved into contact with the toner powder image at transfer station D. The support material is conveyed to station D by a pair of feed rollers 68 and 70. Transfer station D includes a corona generating device 71 which sprays ions onto the backside of sheet 66, thereby attracting a toner powder image from surface 12 to sheet 66. After transfer, the sheet advances to fusing station E where a fusing roller assembly 72 affixes the transferred powder image. After fusing, sheet 66 advances to an output tray (not shown) for subsequent removal by the operator. After the sheet of support material is separated from belt 10, the residual toner particles are removed at cleaning station F.

Figure 2:
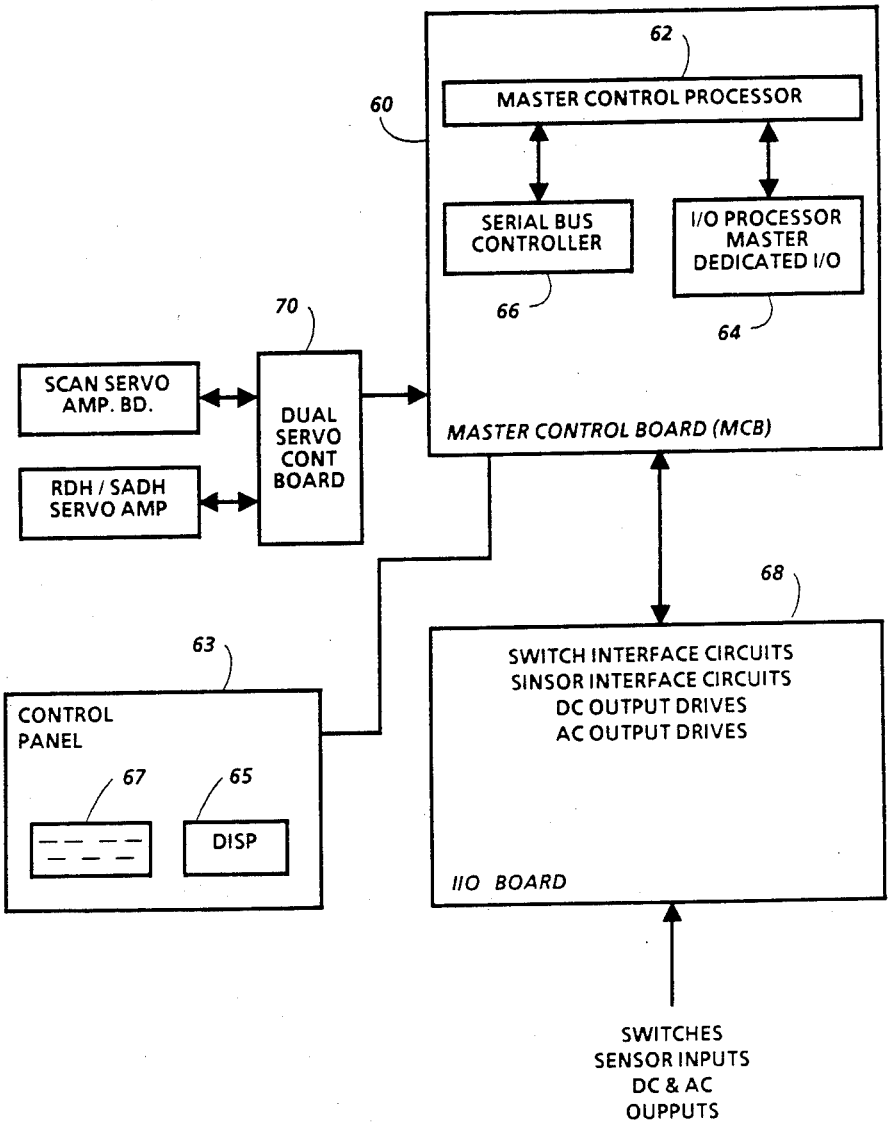
FIG. 2 is a generalized block diagram of the control for use in the machine disclosed in FIG. 1.

With reference to FIG. 2, there is illustrated the general control of the xerographic printing machine. In particular, the controller 31 includes a master control board 60, including an Intel 8085 master control processor 62, an Intel 8085 input/output processor 64 and a serial bus controller 66 connected to an input/output board 68 including various switch and sensor interface circuits and DC and AC output drivers. In a preferred embodiment the master control processor includes 80K ROM, 8K RAM and 2K MBM memories and suitable timing and reset circuitry. The input/output processor includes 8K ROM, 2K RAM, AD and DA converters and an 8253 timer and 8259 interrupt controller, as well as suitable input and output ports. The mastrer control board 60 is also connected to a dual servo control board 70 over a serial bus for handling scan and document handling servos. Also, connected to the master control board 60 is a control panel 63 with suitable display 65 and key board 67 for entering program data and displaying control and diagnostic information.

In accordance with the present invention, to compensate for the instability of the photoconductor surface between cycles 1 and 2 at machine startup or at the beginning of a job run, a process control technique is used that includes both predictive and adaptive parameters. The predictive aspect of this technique is embodied in a predicted voltage increment applied to the voltage to the grid of the charging corotron resulting from a photoconductor surface rest recovery analysis. That is, after the completion of one job production run and before the initiation of the next job production run, there is a period of inactivity or rest of the photoconductor surface. The properties of the photoconductor surface change or recover during this period depending upon the time limit of the period. The predicted increment is intended to represents the actual performance difference on the photoconductor surface between the first and second cycles of the job production run. The adaptive aspect of the technique lies in the derivation of an applied cycle 1 to cycle 2 correction adjustment that is computed as a result of the dark development potential measurement made by the electrostatic volt meter during the job run mode.

In particular, the process control technique predicts the grid voltage $V_G$ to be applied to the charge corotron at cycle up in accordance with the following relationship:

$$V_G = V_{GRR} + C_{\frac{1}{2}} \quad (1)$$

where $V_{GRR}$ is the result of the rest recovery analysis performed by the control and is a function of the voltage at the grid of the corotron at machine cycle out and a function of the time of test $T_R$ of the photoconductive surface between the end of a job run and the beginning of the next job run as described in U.S. Pat. No. 4,512,652 incorporated herein.

In accordance with the present invention, the term $C\frac{1}{2}$ defines the compensation to be made to the charge corotron grid to account for the cyclical variation of the photoconductive surface, particularly, in the first cycles of operation and is defined by the expression:

$$C\tfrac{1}{2}(N+1)=C\tfrac{1}{2}(N)+d[V_{DDPSU}(1/\sigma_2-1/\sigma_1)]$$

where $C(\frac{1}{2}N)$ is the cummulative sum of the last $N-1$ reproduction jobs since installation of the photoreceptor. VDDPSU is the target of the dark development potential established by the control system at corotron startup, sigma is the ratio of the dark development potential to the grid potential as measured in any one charge cycle and d is defined by:

$$d=0,\ V_{DDPSU}(1/\sigma_2-1/\sigma_1)\leqq X \quad (4)$$

$$d=\pm 1,\ Y>V_{DDSU}(1/\sigma_2/\sigma_1)>X$$

$$d=\pm 2,\ V_{DDPSU}(1/\sigma_2-1/\sigma_1)\leqq Y$$

where X and Y are threshold voltage values for the control window. In particular, X is an inner error threshold control voltage and Y is an outer error threshold control voltage.

The term $C\frac{1}{2}$ is therefore the cumulative sum of the last $N-1$ jobs since installation of the machine and an expression of one of the predictive components and the adaptive component account for cyclical variations in the photoconductor surface. The other predictive component in the rest recovery component. The predicted allowance for the cyclical variation in the next cycle is manifested by the expression $C\frac{1}{2}(N+1)$. Equation 3 therefore includes a predictive component $C\frac{1}{2}(N)$ which is the predictive component for the previous cycle and an adaptive component which is generally a function of the ratios of the dark development potential to the grid potential in a first cycle and in a second cycle. To determine these ratios it is merely necessary to measure the dark development potentials during the first and second cycles and record the set grid voltages in both the first and second cycles. It should be noted that it is also possible to express the equation 4 in more general analog terms.

Figure 3:
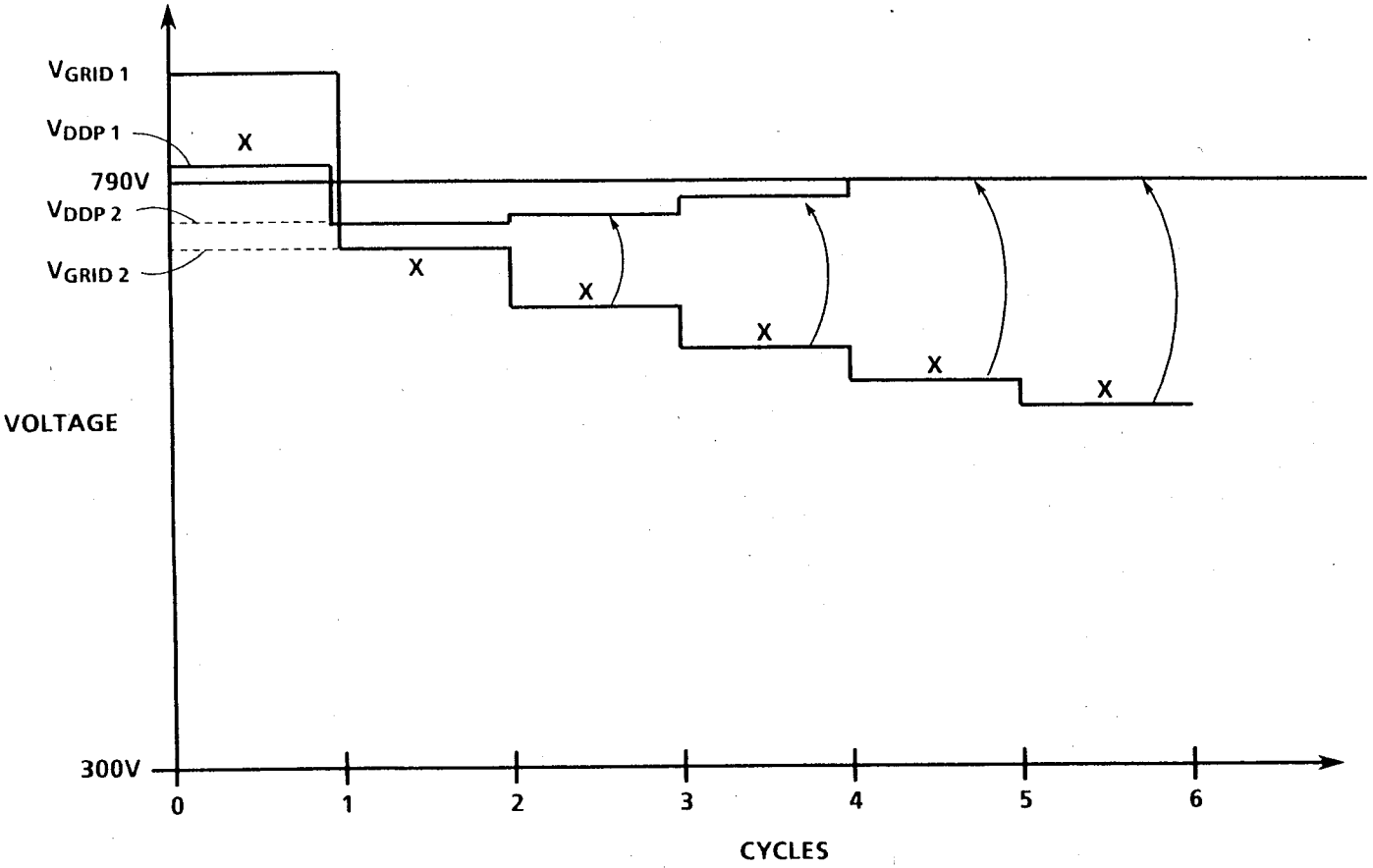
FIG. 3 illustrates the adjustment to the charging corotron between a pair of cycles in accordance with the present invention.

FIG. 3 illustrates the predictive and adaptive components by showing the grid voltage on the corotron with respect to cycles of operation of the machine. An ideal grid voltage in a specific embodiment is illustrated at 790. Thus, in the first cycle, a predicted voltage $V_{GRID}$ 1 is necessary to produce a dark development potential $V_{DDP1}$ more closely approximating the ideal dark development potential of 790 volts. Similarly, during the unstable cycle 2, a predicted voltage $V_{GRID\ 2}$ is necessary to more closely approximate to achieve a dark development potential $V_{DDP2}$ more closely approximately the 790 volts. In a preferred embodiment, after the second cycle, the cyclic instability of the photoconductor surface is assumed to be compensated for and the remaining cycle corrections to the grid voltage are in accordance with the photoconductor surface member rest recovery techniques as described above.

The polarity of the term $C\frac{1}{2}$ is dependent upon the value of the voltage $V_{GRR}$ that is represented by voltage $V_{GRID}$, or $V_G$. In a preferred embodiment, a sign of the increment is the same as the sign of the difference between the dark development potential during cycle 2 less the dark development potential measurement during cycle 1 as illustrated:

$$V_{DDP2}-V_{DDP1} \quad (5)$$

as measured under conditions of constant grid current. If $V_G$ is the result of $V_{GRR}$ the term $C\frac{1}{2}$ will be of opposite sign. This method, particularly the choice of the $C\frac{1}{2}$ discriminator:

$$\mathrm{VDDPSUX}(1/\sigma_2-1/\sigma_1) \quad (6)$$

where VDDPSU is a representation of the ideal dark development potential, offers one clear advantage over using the simple difference in dark development potential from cycle 1 to cycle 2. In the event the machine is designed to use more than one dark development potential set point in its copy modes, no conversion in the $C\frac{1}{2}$ discriminator is required for reads or measurements taken in the alternate dark development potential mode.

While there has been illustrated and described what is at present considered to be a preferred embodiment of the present invention, it would be appreciated that numerous changes and modifications are likely to occur to those skilled in the art, and it is intended in the appended claims to cover all those changes and modifications which fall within the true spirit and scope of the present invention.

I claim:

1. A control device for adjusting the surface potential of an image bearing member of a machine during the initial cycles of a job run, the image bearing member manifesting varying characteristics after completion of a job run, comprising:

output means for use in forming a latent image on the image bearing member wherein the output means produces a signal to control the surface potential of the image bearing member, measuring means to measure the surface potential on said image bearing member, and means responsive to the output means and the measuring means after a first cycle of the machine operation to change the signal of the output means during a second cycle of the machine, the responsive means including means to predict the changed characteristics of the image bearing member after the completion of a first job run at the initiation of a second job run and means to determine a relationship between the signal produced by the output means and the surface potential of the image bearing member.

2. The control of claim 1 wherein the output means is a charging corotron providing a charging potential and said relationship is the ratio of the measured surface potential to said charging potential.

3. The control means of claim 1 wherein the means to predict is a function of the signal from the output means for a previous job run.

4. The control of claim 1 wherein the measuring means is an electrostatic voltmeter.

5. A control device for adjusting the surface potential of an image bearing member during cycle up comprising:

output means for use in forming a latent image on the image bearing member wherein the output means produces a signal to control the surface potential of the image bearing member, measuring means to measure the surface potential on said image bearing member, and means responsive to the output means and the measuring means after a first cycle of the machine to change the signal of the output means during a second cycle of the machine, the responsive means including a predictive component and a corrective component for enabling the printing of acceptable copy on unstable first cycles of the image bearing member.

6. The control of claim 5 wherein the predictive component is a function of the recovery characteristics of the image bearing member.

7. The control of claim 5 wherein the corrective component is a function of the output of said measuring means.

8. The control device of claim 5 wherein the output means is a charging corotron and the measuring means is an electrostatic voltmeter.

9. The control of claim 5 wherein the predictive component is a function of the charge retaining properties of the image bearing member and the signal from the output means, and the corrective component is a function of a relationship between the surface potential of the image bearing member and a signal of the output means.

10. An image bearing apparatus provided with a control device for adjusting the surface potential of an image bearing member of the image bearing apparatus including:

output means for use in forming a latent image on the image bearing member wherein the output means produces a variable output to control the surface potential of the image bearing member, measuring means to measure the surface potential on said image bearing member, means to compare the magnitude of an output of the measuring device with respect to a reference value, means for changing the reference value in response to a compared output, said compare means having an output coupled to the output means providing an adaptive component to the output means wherein the improvement comprises prediction means providing a predictive component for controlling the variable output of of the output means during the initial cycles of the image bearing apparatus.

11. A control device for adjusting the surface potential of an image bearing member of a machine during the initial cycles of a job run, the image bearing member manifesting varying characteristics after completion of a job run, comprising:

output means for use in forming a latent image on the image bearing member wherein the output means produces a signal to control the surface potential of the image bearing member, measuring means to measure the surface potential on said image bearing member, and means responsive to the output means and the measuring means after a first cycle of the machine operation to change the signal of the output means during a second cycle of the machine, the responsive means including means to predict the changed characteristics of the image bearing member after the completion of a first job run at the initiation of a second job run.

12. The control of claim 11 wherein the output means is a charging corotron providing a charging potential and including the means to determine the ratio of the measured surface potential to said charging potential.

* * * * *